US006431316B1

(12) United States Patent
Bothwell

(10) Patent No.: US 6,431,316 B1
(45) Date of Patent: Aug. 13, 2002

(54) SCAFFOLD PLANK AND METHOD OF MAKING THE SAME

(76) Inventor: Timothy Benson Bothwell, 6766 Nicolett, Riverside, CA (US) 92504

( * ) Notice: Subject to any disclaimer, the term of this patent is extended or adjusted under 35 U.S.C. 154(b) by 0 days.

(21) Appl. No.: 09/614,079

(22) Filed: Jul. 11, 2000

Related U.S. Application Data

(60) Provisional application No. 60/143,535, filed on Jul. 13, 1999.

(51) Int. Cl.[7] ..... E04G 5/08
(52) U.S. Cl. ..... 182/222; 182/119; 182/46
(58) Field of Search ..... 182/222, 223, 182/119, 46

(56) References Cited

U.S. PATENT DOCUMENTS 1,975,262 A * 10/1934 Evans
4,496,029 A 1/1985 Kuroda
4,852,691 A 8/1989 Bruno
5,596,933 A * 1/1997 Knight ..... 108/51.1
5,882,136 A * 3/1999 Pyritz ..... 182/222

FOREIGN PATENT DOCUMENTS

GB 1148927 * 4/1969 ..... 182/222
GB 2234003 * 1/1991 ..... 182/222

* cited by examiner

*Primary Examiner*—Alvin Chin-Shue
(74) *Attorney, Agent, or Firm*—Stetina Brunda Garred & Brucker

(57) ABSTRACT

A scaffold plank comprising a rectangularly configured main body which defines opposed ends, and a pair of end caps secured to respective ones of the opposed ends of the main body. Both the main body and the end caps are preferably fabricated from a recycled/recyclable plastic material. Additionally, the main body may be provided with one or more internal steel reinforcement bars for purposes of selectively increasing the level of structural integrity/rigidity thereof.

7 Claims, 3 Drawing Sheets

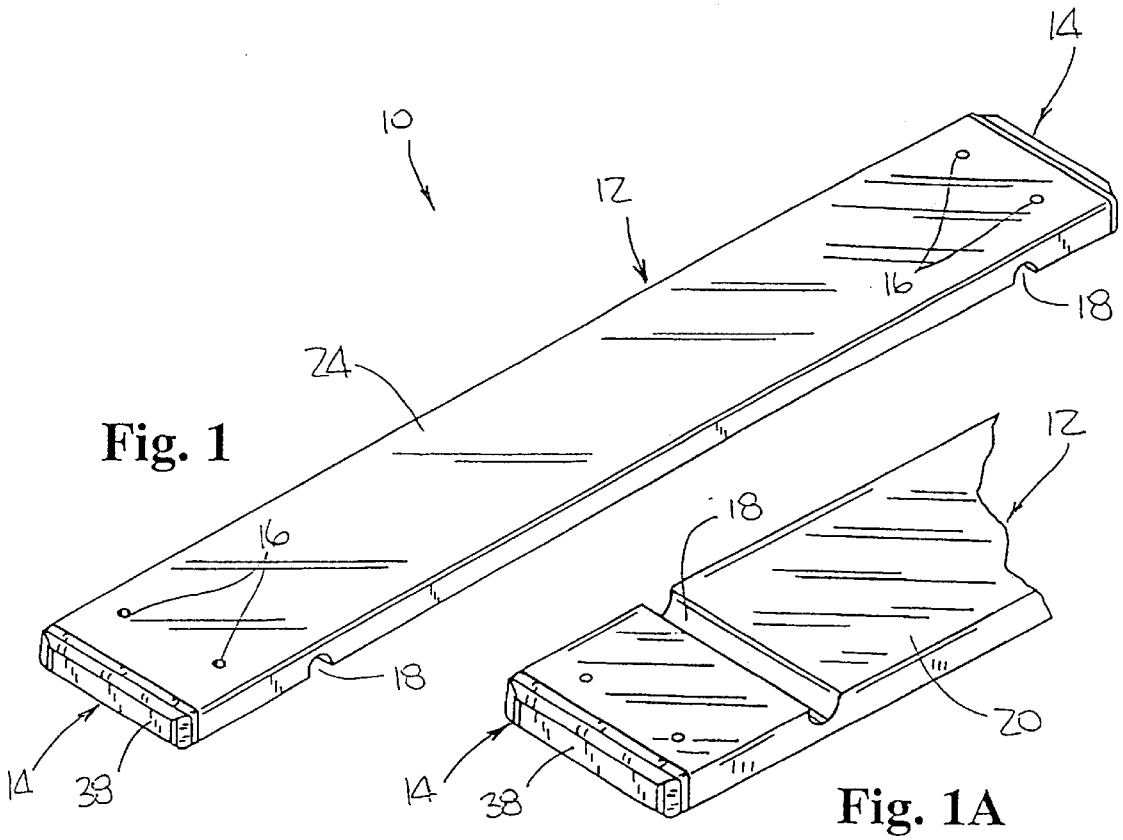
Fig. 1
Fig. 1A
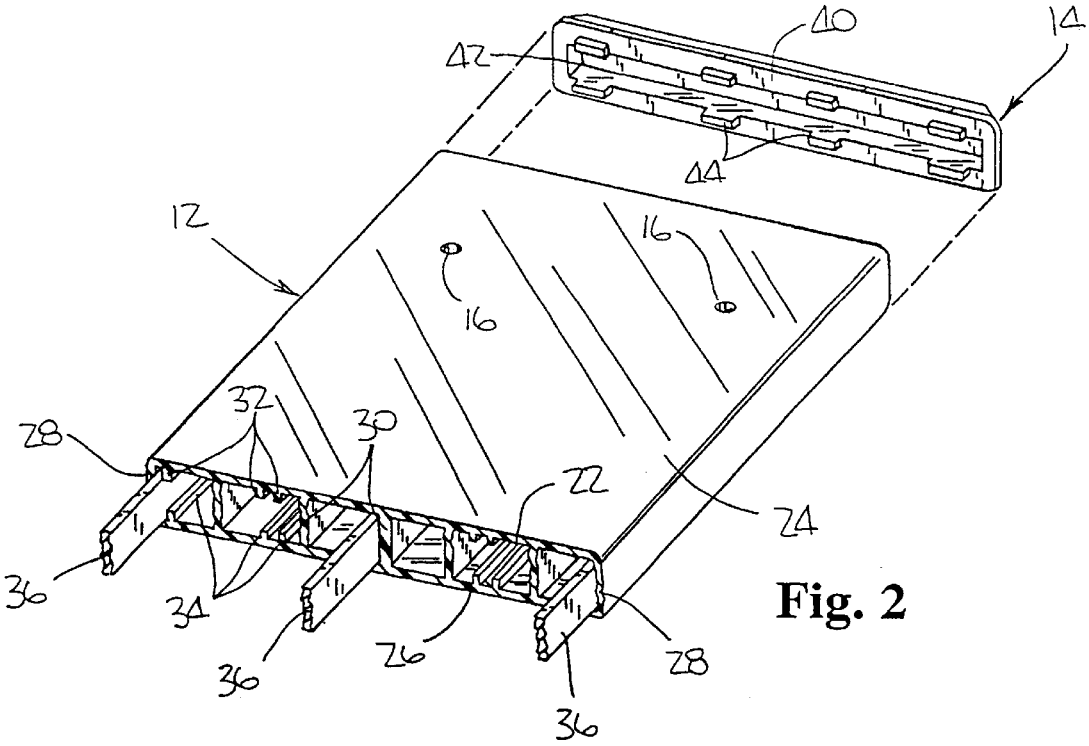
Fig. 2

SCAFFOLD PLANK AND METHOD OF MAKING THE SAME

CROSS-REFERENCE TO RELATED APPLICATIONS

The present application claims priority to U.S. Provisional Application Ser. No. 60/143,535 entitled IMPROVED SCAFFOLD PLANK AND METHOD OF MAKING THE SAME filed Jul. 13, 1999.

STATEMENT RE: FEDERALLY SPONSORED RESEARCH/DEVELOPMENT (Not Applicable)

BACKGROUND OF THE INVENTION

The present invention relates generally to scaffolding systems, and more particularly to a scaffold plank fabricated from a plastic material and optionally reinforced with steel.

As is well known in the building industry, scaffolding is virtually always employed during various facets of exterior and/or interior building construction or refurbishment. Known scaffolding systems typically comprise steel support frame structures which are selectively engageable to each other in a stacked fashion for achieving a desired overall height. In addition to the support frame structures, the scaffolding system includes a multiplicity of elongate scaffold planks, each of which is horizontally extensible between a respective pair of the support frame structures. The prior art scaffold planks are most typically fabricated from wood. Indeed, the use of wood for the prior art scaffold planks has been a long standing tradition in the building industry.

Though wood scaffold planks have been and continue to be generally suitable for use in scaffolding systems, the use of wood for the scaffolding planks gives rise to certain shortcomings and deficiencies which detract from their overall utility. More particularly, scaffold planks fabricated from wood are susceptible to splitting as well as to dry rot. Additionally, when exteriorly used scaffolding systems are subjected to a rain or thunder storm as often occurs, the resultant water soaking of the wood scaffold planks virtually doubles their weight as compared to when dry, thus substantially increasing the difficulty by which they are moved or otherwise manipulated. Such water soaking of the wood scaffold planks also often results in the warping or twisting thereof. As will be recognized, due to their susceptibility to splitting, dry rot and warping/twisting, the prior art wood scaffold planks have a reasonably limited life span, and require moderately frequent replacement.

Another drawback associated with the use of wood scaffold planks is the common occurrence of scaffold setters experiencing splinters in their hands when working with the same. Indeed, occurrences of splinters can reach a level of severity resulting in the initiation of a workers compensation claim. Moreover, because nails are also often used in conjunction with wood scaffold planks, workers are more susceptible to being injured by nails which are left therewithin.

A further problem associated with the use of wood scaffold planks is the relatively high cost thereof attributable to diminishing supplies of lumber. Indeed, ongoing extensive worldwide deforestation and the related environmental and ecological problems has, in addition to resulting in increases in the price of lumber, stimulated a movement to adopt lumber alternatives for purposes of contributing to the conservation and restoration of forests. These diminishing supplies of lumber also frequently give rise to delays in the delivery of lumber raw material to those mills which manufacture wood scaffold planks, thus resulting in periodic problems in meeting the supply demands of the building industry.

The present invention addresses these concerns by providing a scaffold plank which is manufactured or fabricated from a plastic material and may optionally be reinforced with a metallic material. As will be discussed below, the plastic scaffold plank of the present invention, though possessing the same level of structural integrity or rigidity as the prior art wood scaffold planks, does not have the same susceptibility to splitting, dry rot or warping/twisting. Additionally, the weight of the plastic scaffold plank of the present invention is the same whether wet or dry. The use of plastic for the scaffold planks of the present invention also eliminates occurrences of splinters, and substantially eliminates injuries potentially caused by nails left therein. Further, since the scaffold planks of the present invention may be fabricated from recycled/recyclable plastic material, they address the need of recycling used plastic into a useful product, in addition to satisfying the increasing desire in industry for lumber alternatives. These, and other features of the present invention will be described in more detail below.

BRIEF SUMMARY OF THE INVENTION

In accordance with a first embodiment of the present invention, there is provided a scaffold plank which has an elongate, generally rectangular configuration and includes a main body which defines opposed ends. Attached to respective ones of the opposed ends of the main body is a pair of identically configured end caps. The main body of the scaffold plank itself comprises top and bottom walls and an opposed pair of longitudinally extending sidewalls which are integrally connected to the top and bottom walls. Integrally connected to and extending perpendicularly between the top and bottom walls are multiple reinforcement webs which extend in generally parallel relation to each other, thus defining multiple compartments or cavities which extend longitudinally within the interior of the main body. Also formed on the top wall and extending longitudinally therealong within the interior of the main body are multiple ribs which, along with the top and bottom walls and reinforcement webs, collectively define multiple slots which are each adapted to accommodate a reinforcement bar. Both the main body and the end caps are preferably fabricated from a plastic material (e.g., virgin or recycled plastic), with the attachment of the end caps to the main body preferably being accomplished through the use of sonic welding, pins, snap fit, or an adhesive. Additionally, the main body is preferably fabricated through the use of an extrusion process, with the end caps each preferably being fabricated through the use of an injection molding process.

In accordance with a second embodiment of the present invention, there is provided a scaffold plank which includes a rectangularly configured main body having a top wall, an opposed pair of longitudinally extending sidewalls which are preferably integrally connected to the top wall, and an opposed pair of end walls which are preferably integrally connected to the top and sidewalls and define respective ones of the opposed ends of the scaffold plank. The main body of the scaffold plank of the second embodiment is formed to include multiple channel members which are integrally connected to the top wall and, together with the top wall alone or in combination with the sidewalls, collectively define multiple slots which are each sized and configured to accommodate a reinforcement bar. Also integrally connected to the top wall are multiple primary reinforcement webs which are disposed between and extend in generally parallel relation to adjacent pairs of the channel members. Integrally connected to and extending angularly between each of the primary reinforcement webs and the channel members of a corresponding pair are a plurality of secondary reinforcement webs which are also integrally connected to the top wall.

The scaffold plank of the second embodiment may further comprise a cover member which is attached to the main body through the use of, for example, sonic welding or an adhesive. Both the main body and the cover member are preferably fabricated from a plastic material (e.g., virgin or recycled plastic). Additionally, the main body and the cover member are each preferably fabricated via an injection molding, rotational molding, or vacuum forming process, with the reinforcement bars, if any, being pre-positioned within the mold and the plastic material thereafter being injection molded about the same.

BRIEF DESCRIPTION OF THE DRAWINGS

These, as well as other features of the present invention, will become more apparent upon reference to the drawings wherein:

FIG. 1 is a top perspective view of a scaffold plank constructed in accordance with a first embodiment of the present invention;

FIG. 1A is a partial bottom perspective view of the scaffold plank shown in FIG. 1, illustrating the optional inclusion of a frame setting notch in the underside thereof;

FIG. 2 is a partial top perspective, cut-away view of the scaffold plank constructed in accordance with the first embodiment of the present invention, illustrating its end cap as being exploded from the main body thereof;

DETAILED DESCRIPTION OF THE INVENTION

Figure 2A:
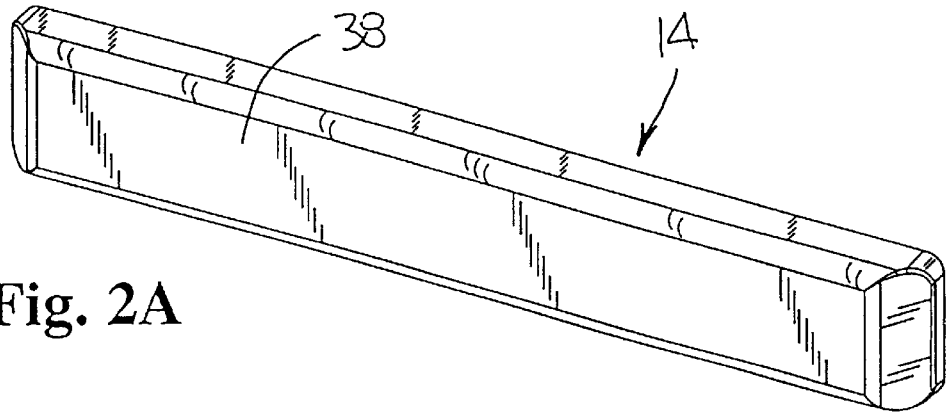
FIG. 2A is a front perspective view of the end cap of the scaffold plank of the first embodiment of the present invention, the rear perspective view of the end cap being shown in FIG. 2.

Referring now to the drawings wherein the showings are for purposes of illustrating preferred embodiments of the present invention only, and not for purposes of limiting the same, FIG. 1 perspectively illustrates a scaffold plank 10 constructed in accordance with a first embodiment of the present invention. The scaffold plank 10 has an elongate, generally rectangular configuration and includes a main body 12 which defines opposed ends. Attached to respective ones of the opposed ends of the main body 12 is a pair of identically configured end caps 14, the precise structural attributes of which will be described in more detail below. In the first embodiment, the preferred height or thickness of the scaffold plank 10 is in the range of from about 1.0 inch to about 2.50 inches, and is preferably about 1.50 inches. The preferred width of the scaffold plank 10 is in the range of from about 6.0 inches to about 15.0 inches, and is preferably about 9.50 inches.

The overall length of the scaffold plank 10 (including the main body 12 and end caps 14) is variable. In this respect, it is contemplated that the scaffold plank 10 may be provided to have an overall length of either 6 feet, 9 feet, 12 feet, or 16 feet. However, those of ordinary skill in the art will recognize that the scaffold plank 10 of the present invention may be fabricated to have length, width, and/or height dimensions differing from those described above.

As seen in FIGS. 1 and 1A, the scaffold plank 10 may be provided with two pairs of pre-formed nail holes 16, with each pair of the nail holes 16 being disposed within the body 12 in relative close proximity to a respective one of the end caps 14. In addition to the nail holes 16, the main body 12 of the scaffold plank 10 may be formed to include a spaced pair of arcuately contoured, concave frame setting notches 18 in the underside or bottom surface 20 thereof. As will be described in more detail below, the nail holes 16 and/or frame setting notches 18, if included, are preferably formed in the main body 12 via finishing operations conducted subsequent to the fabrication of the main body 12. The nail holes 16 and/or frame setting notches 18 are used to facilitate the engagement or interface of the scaffold plank 10 to a conventional steel frame support structure of a scaffolding system.

Referring now to FIGS. 2 and 2A, the main body 12 of the scaffold plank 10 itself comprises a top wall 22 which defines a top surface 24, a bottom wall 26 which defines the bottom surface 20, and an opposed pair of longitudinally extending sidewalls 28 which are integrally connected to the top and bottom walls 22, 26. Integrally connected to and extending perpendicularly between the top and bottom walls 22, 26, and in particular the inner surfaces thereof, are five (5) reinforcement webs 30. The reinforcement webs 30 extend in generally parallel relation to each other, thus defining six (6) compartments or cavities which extend longitudinally within the interior of the main body 12. In the scaffold plank 10, the preferred thickness of the top, bottom and sidewalls 22, 26, 28 and reinforcement webs 30 is approximately 0.1875 inches.

As further seen in FIG. 2, formed on the inner surface of the top wall 22 and extending longitudinally therealong in spaced, generally parallel relation to each other are seven (7) ribs 32. Similarly, formed on and extending longitudinally along the inner surface of the bottom wall 26 in spaced, generally parallel relation to each other are seven (7) ribs 34 which are disposed in opposed, aligned relation to respective ones of the ribs 32. The ribs 32, 34 extend generally perpendicularly from the inner surfaces of the top and bottom walls 22, 26, respectively. In the scaffold plank 10, the top, bottom and sidewalls 22, 26, 28 and ribs 32, 34 extending within the outermost pair of cavities collectively form a pair of slots which are each adapted to accommodate an elongate, rectangularly configured reinforcement bar 36. The centermost pair of ribs 32, 34, top and bottom walls 22, 26, and centermost reinforcement web 30 also collectively define a slot which is adapted to accommodate a third reinforcement bar 36. The four remaining ribs 32 and four remaining ribs 34 collectively define two more slots which extend within respective ones of those cavities disposed adjacent the outermost pair and are adapted to accommodate two additional reinforcement bars 36. In the scaffold plank 10, the reinforcement bars 36 are each preferably fabricated from steel having a thickness of approximately 0.1875 inches.

In the scaffold plank 10 shown in FIG. 2, three (3) reinforcement bars 36 are depicted as being disposed within respective ones of the five (5) slots extending within the interior of the main body 12. Those of ordinary skill in the art will recognize that no reinforcement bars 36 need be provided within the main body 12, and that less than three or up to five reinforcement bars 36 may be included therein. The number of reinforcement bars 36, if any, included in the interior of the main body 12 of the scaffold plank 10 is dependent upon the level of structural integrity or rigidity desired in relation thereto. In the scaffold plank 10, each of the reinforcement bars 36 is preferably sized such that when disposed within the interior of the main body 12 in the above-described manner, the opposed ends thereof do not protrude beyond respective ones of the opposed ends of the main body 12.

As indicated above, in addition to the main body 12, the scaffold plank 10 includes the end caps 14 which are attached to respective ones of the opposed ends of the main body 12. As seen in FIGS. 2 and 2A, each of the end caps 14 has a generally rectangular configuration, and includes an outer surface 38 which defines a pair of beveled or concave corner regions adjacent respective ones of the lateral sides thereof. In addition to the outer surface 38, each end cap 14 has an inner surface 40 which includes an elongate channel 42 formed therein. The channel 42 is formed within each end cap 14 for purposes of reducing the overall weight thereof. As seen in FIG. 2, the channel 42 terminates inwardly of the lateral sides of the end cap 14.

Formed on the inner surface 40 of each end cap 14 are a total of eight (8) rectangularly configured attachment tabs 44. The attachment tabs 44 are arranged in two sets of four, with the attachment tabs 44 of each set being disposed in spaced relation to each other along a respective one of the longitudinal sides of the channel 42. Additionally, the attachment tabs 44 of one set are disposed in opposed, linear alignment with respective ones of the attachment tabs 44 of the other set. Importantly, the attachment tabs 44 are oriented so as to be advanceable into respective ones of the cavities defined within the main body 12 and not interfere with any of the reinforcement webs 30 thereof. In this respect, the attachment tabs 44 are sized and configured such that when each opposed pair thereof is received into a respective one of the cavities of the main body 12, those edges of the attachment tabs 44 disposed furthest from the channel 42 are in abutting contact with the inner surfaces of respective ones of the top and bottom walls 22, 26 of the main body 12. Those of ordinary skill in the art will recognize that different numbers of attachment tabs 44 arranged in alternative patterns are contemplated in relation to the end caps 14. In the scaffold plank 10, each of the end caps 14 may be sonically welded to the main body 12, or may alternatively be attached to the main body 12 through the use of fasteners such as pins, snap fit, or an adhesive. However, those of ordinary skill in the art will recognize that other methods may be employed to facilitate the attachment of the end caps 14 to the main body 12. As is seen in FIG. 1, the end caps 14 are sized relative to the main body 12 such that when attached thereto, the longitudinal sides of the end caps 14 are substantially flush with the bottom surface 20 of the bottom wall 26 and top surface 24 of the top wall 22, with the lateral sides of the end caps 14 being substantially flush with the outer surfaces of the sidewalls 28.

Both the main body 12 and end caps 14 of the scaffold plank 10 are preferably fabricated from a plastic material. A preferred plastic material is a ten percent to fifty percent glass-filled polypropylene/nylon blend. Such plastic material may alternatively comprise either virgin or recycled plastic. It is contemplated that the plastic or nylon material may be filled with either glass or another suitable reinforcement material to increase the structural integrity/rigidity thereof. Those of ordinary skill in the art will further recognize that the main body 12 and end caps 14 need not necessarily be fabricated from identical materials. In this respect, each of the end caps 14 could be fabricated from a metallic material such as aluminum. As indicated above, each of the reinforcement bars 36 is preferably fabricated from steel.

Additionally, the main body 12 of the scaffold plank 10 is preferably fabricated via an extrusion process. If one or more reinforcement bars 36 is to be included within the interior of the main body 12, it is preferred that the plastic material used to form the main body 12 will be extruded about the reinforcement bar(s) 36. However, those of ordinary skill in the art will recognize that the reinforcement bars 36 may be inserted into the interior of the main body 12 via a separate procedure which is conducted subsequent to the formation of the main body 12 via the extrusion process. The end caps 14 are themselves preferably fabricated through the use of an injection molding or vacuum forming process and, as indicated above, secured to respective ones of the opposed ends of the main body 12 subsequent to the fabrication of the same.

Subsequent to the fabrication of the main body 12 via the extrusion process, it is contemplated that the nail holes 16 may be formed therein via a follow-up drilling operation. Additionally, the frame setting notches 18 may be formed in the bottom surface 20 via a follow-up grinding or machining operation. Moreover, the top surface 24 of the top wall 22 may be subjected to a grinding or machining operation for purposes of applying a texture or roughened feature thereto. Though not shown, it is further contemplated that the cavities defined by the main body 12 may be filled with structural foam or some equivalent thereto prior to the attachment of the end caps 14 to the main body 12 for purposes of increasing the structural strength or rigidity of the completed scaffold plank 10.

Figure 3:
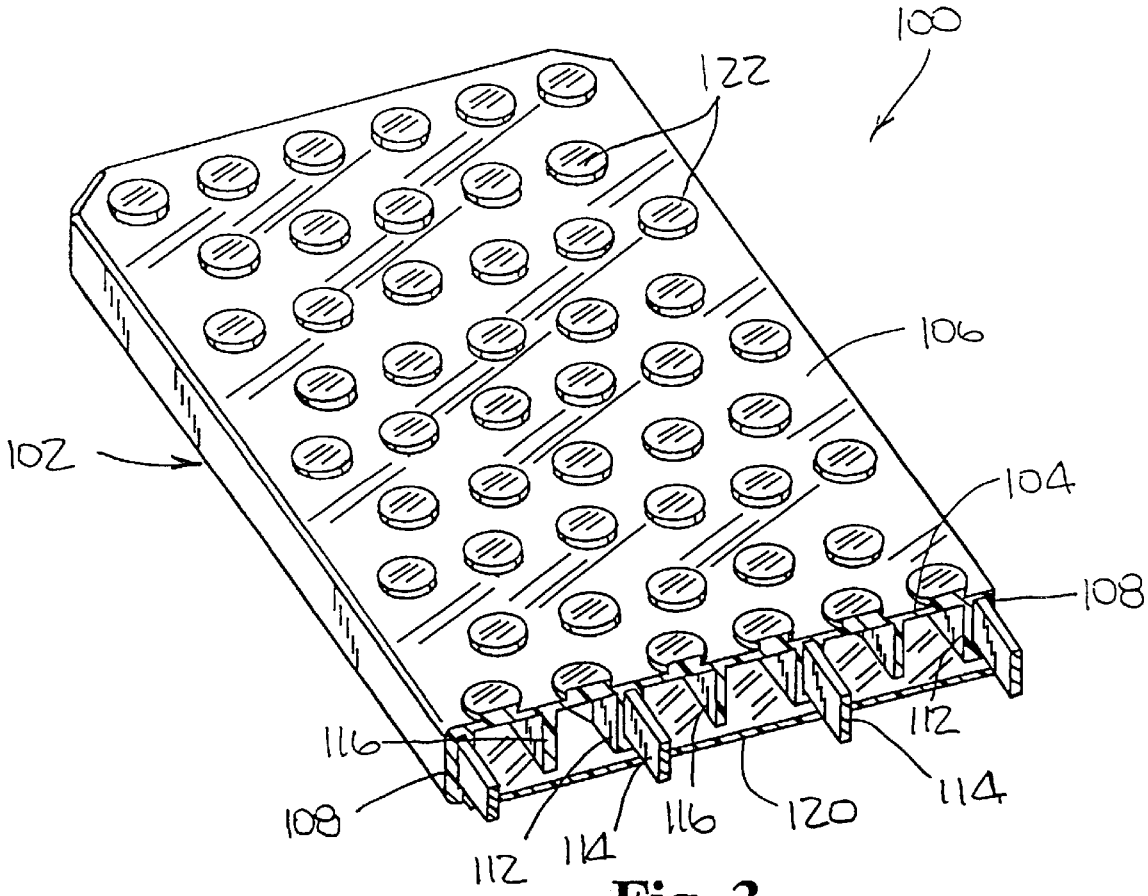
FIG. 3 is a partial top perspective, cut-away view of a scaffold plank constructed in accordance with a second embodiment of the present invention.
Figure 4:
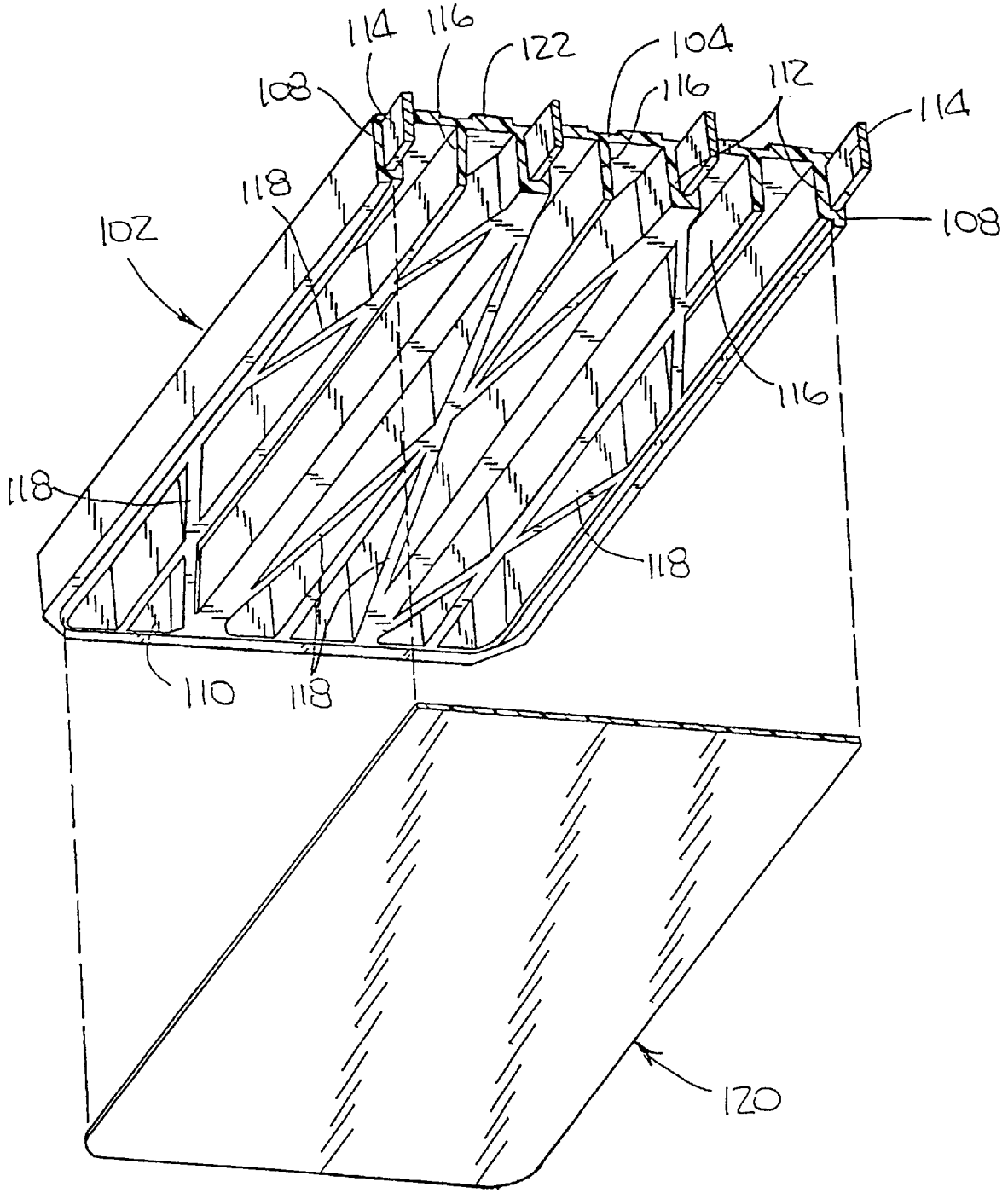
FIG. 4 is a partial bottom perspective, cut-away view of the scaffold plank shown in FIG. 3, illustrating its bottom cover as being exploded from the main body thereof.

Referring now to FIGS. 3 and 4, there is depicted a scaffold plank 100 constructed in accordance with a second embodiment of the present invention. The scaffold plank 100 also has an elongate, generally rectangular configuration and includes a main body having a top wall 104 which defines a top surface 106, an opposed pair of longitudinally extending sidewalls 108 which are integrally connected to the top wall 104, and an opposed pair of end walls 110 which are integrally connected to the top and sidewalls 104, 108 and define respective ones of the opposed ends of the scaffold plank 100. Though the scaffold plank 100 of the second embodiment preferably does not include the previously described end caps 14 since the opposed ends thereof are defined by the end walls 100 of the main body 102, those of ordinary skill in the art will recognize that such end caps 14 may be employed as an alternative to the integrally formed end walls 100. Similar to the configuration of the outer surfaces 38 of the end caps 14, the end walls 110 of the main body 102 may be formed to include beveled corner regions adjacent respective ones of the sidewalls 108.

As is seen in FIGS. 3 and 4, the main body 102 of the scaffold plank 100 is formed to include four (4) channel members 112 which are integrally connected to the inner surface of the top wall 104 and extend longitudinally therealong in spaced, generally parallel relation to each other. The outermost pair of channel members 112 each have a generally L-shaped configuration and, in addition to being integrally connected to the inner surface of the top wall 104, are integrally connected to the inner surfaces of respective ones of the sidewalls 108. The central two channel members 112 each have a generally U-shaped configuration and are integrally connected to only the inner surface of the top wall 104. In the scaffold plank 100, the outermost pair of channel members 112 and inner surfaces of the top and sidewalls 104, 108 collectively define a pair of slots, with another pair of slots being collectively defined by the central two channel members 112 and inner surface of the top wall 104. Each of these four (4) slots has a generally rectangular configuration and extends substantially along the length of the main body 102. Additionally, each of these slots is sized and configured to accommodate a reinforcement bar 114 which is identically configured to the previously described reinforcement bar 36 and preferably fabricated from steel.

In addition to the channel members 112, integrally connected to and extending perpendicularly from the inner surface of the top wall 104 are three (3) longitudinally extending primary reinforcement webs 116. In the scaffold plank 100, each of the primary reinforcement webs 116 is disposed equidistantly between an adjacent pair of channel members 112 and extends in generally parallel relation thereto. Integrally connected to and extending angularly between each of the primary reinforcement webs 116 and the channel members 112 of the corresponding pair are a plurality of secondary reinforcement webs 118 which are also integrally connected to the inner surface of the top wall 104 and extend generally perpendicularly relative thereto. As is best seen in FIG. 4, the channel members 112 and primary and secondary reinforcement webs 116, 118 are each sized and configured such that the distal surfaces thereof (i.e., those surfaces disposed furthest from the inner surface of the top wall 104) are oriented inwardly from the distal edges of the sidewalls 108 and end walls 110 (or end caps 14) of the main body 102. In this respect, the distal edges of the side and end walls 108, 110 of the main body 102 protrude slightly outwardly from the distal surfaces of the channel members 112 and primary and secondary reinforcement webs 116, 118 for reasons which will be described in more detail below.

In addition to the main body 102, the scaffold plank 100 of the second embodiment may comprise a cover member 120 which also has an elongate, generally rectangular configuration and defines opposed, generally planar surfaces. In the scaffold plank 100, the cover member 120 is attached to the main body 102 such that the inner surface of the cover member 120 lies in abutting contact with the distal surfaces of the channel members 112 and primary and secondary reinforcements webs 116, 118. In this respect, the length in width dimensions of the cover member 20 are slightly smaller than those of the main body 102 such that when the inner surface of the cover member 120 is placed into abutting contact with the channel members 112 and primary and secondary reinforcement webs 116, 118 in the aforementioned manner, the outer surface of the cover member 120 is substantially flush or continuous with the distal edges of the side and end walls 108, 110 of the main body 102.

The attachment of the cover member 120 to the main body 102 is preferably facilitated through the use of sonic welding, pins, or an adhesive. However, those of ordinary skill in the art will recognize that other methods may be employed to facilitate the attachment of the cover member 120 to the main body 102. Since the cover member 120, when attached to the main body 102, does not protrude beyond the side and end walls 108, 110 of the main body 102, the overall length, width and height dimensions of the scaffold plank 100 are governed by the main body 102 thereof. Though not shown, it is contemplated that a sealing strip may be extended along the side and end walls 108, 110 of the main body 102 in a manner wherein such sealing strip is compressed between the cover member 120 and the main body 102 when the cover member 120 is attached to the main body 102.

In the second embodiment, the preferred height or thickness of the main body 102, and hence the scaffold plank 100, is in the range of from about 1.0 inch to about 2.50 inches, and preferably about 1.50 inches. The preferred width of the main body 102 is in the range of from about 6.0 inches to about 15.0 inches, and is preferably about 9.50 inches. The overall length of the main body 102 is variable, with it being contemplated that the same may be provided in lengths of either 6 feet, 9 feet, 12 feet, or 16 feet.

Like the main body 12 and end caps 14 of the scaffold plank 10 of the first embodiment, both the main body 102 and cover member 120 of the scaffold plank 100 of the second embodiment are preferably fabricated from a plastic material. As in the first embodiment, a preferred plastic material is a ten percent to fifty percent glass-filled polypropylene/nylon blend. An alternative plastic material may be either virgin or recycled plastic. It is contemplated that the plastic or nylon material may be filled with either glass or another suitable reinforcement material to increase the structural integrity/rigidity thereof. As indicated above, each of the reinforcement bars 114 is preferably fabricated from steel. However, the reinforcement bars 114 as well as the above-described reinforcement bars 36 may each be fabricated from a material other than for steel.

In the scaffold plank 100 shown in FIGS. 3 and 4, four (4) reinforcement bars 114 are depicted as being disposed within respective ones of the four (4) slots extending within the interior of the main body 102. Those of ordinary skill in the art will recognize that no reinforcement bars 114 need be provided within the main body 102, and that less than four (4) reinforcement bars 114 may be included therein. The number of reinforcement bars 114, if any, included in the interior of the main body 102 of the scaffold plank 100 is dependent upon the level of structural integrity or rigidity desired in relation thereto. Additionally, though the main body 102 is shown as including four (4) channel members 112 and three (3) primary reinforcement webs 116, those of ordinary skill in the art will recognize that the main 102 may be formed to include greater or fewer channel members 112 and/or primary reinforcement webs 116.

As indicated above, no reinforcement bars 114 need to be provided within the main body 102. In this respect, it is contemplated that as an alternative to the reinforcement bars 114 being included in the main body 102, the channel members 112 may be formed to be of a solid cross-sectional configuration as opposed to partially defining the above-described rectangularly configured slots. In this respect, based upon the particular plastic material used to form the main body 102, the formation of the same with the solid channel members 102 may be sufficient to impart the desired amount of structural integrity/rigidity to the scaffold plank 100.

In the second embodiment, the main body 102 of the scaffold plank 100 is preferably fabricated via an injection molding process, as is the cover member 120 thereof. If one or more reinforcement bars 114 is to be included within the interior of the main body 102, such reinforcement bar(s) 114 will typically be pre-positioned within the mold, with the plastic material thereafter being injection molded about the same, thus resulting in the reinforcement bars 114 being molded in place. Additionally, as seen in FIG. 3, it is contemplated that the mold may be formed to provide the top surface 106 of the top wall 104 with non-skid characteristics through the formation of multiple, generally circular protuberances 122 thereon, with such protuberances 122 being arranged in generally parallel rows. As an alternative to being formed to include the protuberances 122, the top surface 106 of the top wall 104 may be subjected to a follow-up grinding or machining operation subsequent to the molding of the main body 102 for purposes of applying a texture or roughened feature thereto. The outer surface of the cover member 120 may also be formed to include a texture or roughened feature. Though the main body 102 and the cover member 120 are preferably fabricated via an injection molding process, it is contemplated that either or both of the main body 102 and cover member 120 may be fabricated via a vacuum forming or extrusion process. Additionally, though not shown, it is contemplated that the previously described nail holes 16 and/or frame setting notches 18 may be formed within the scaffold plank 100 via processes/techniques similar to those previously described in relation to the scaffold plank 10 of the first embodiment.

It is contemplated that in the scaffold plank 100 of the second embodiment, the cover member 120 may be formed as an integral portion of the main body 102 as opposed to a separate component attached thereto. In this respect, the main body 102 including the cover member 120 as an integral portion thereof may be formed or fabricated as a totally symmetrical component or part. Both of the sides or faces of such symmetrical part could be provided with a texture or roughened feature, with the absence of any nail holes 16 and frame setting notches 18 allowing the same to be positioned upon scaffolding in any orientation. If formed to include the cover member 120 as an integral portion thereof, it is contemplated that the main body 102 will be molded in two identical halves defined by bisecting the side walls 108 with a common plane. These two symmetrical halves of the main body 102 (one of which would include the integrally formed cover member 120) would be attached to each other via sonic welding or an adhesive to facilitate the formation of the scaffold plank 100. Each of the symmetrical halves could be individually fabricated via injection molding, rotational molding, or a vacuum forming process.

Additional modifications and improvements of the present invention may also be apparent to those of ordinary skill in the art. In this respect, the planks formed in accordance with the present invention may be used in applications other than for scaffolding. Thus, the particular combination of parts described and illustrated herein is intended to represent only certain embodiments of the present invention, and is not intended to serve as limitations of alternative devices within the spirit and scope of the invention.

What is claimed is:

1. A scaffold plank comprising:

a main body including:

an elongate, generally rectangular top wall defining inner and outer surfaces and having opposed pairs of longitudinal and lateral sides;

an opposed pair of side walls integrally connected to the top wall and extending along respective ones of the longitudinal sides in generally parallel relation to each other, each of the side walls defining an inner surface; and a reinforcement structure comprising:

at least four elongate channel members integrally connected to and extending longitudinally along the top wall in generally perpendicular relation thereto, the channel members being spaced from each other in substantially equidistant intervals, with two of the channel members further being integrally connected to the inner surfaces of respective ones of the side walls; and at least three primary reinforcement webs integrally connected to and extending longitudinally along the inner surface of the top wall in generally perpendicular relation thereto and substantially intermediate a respective pair of the channel members, the channel members and the primary reinforcement webs extending in generally parallel relation to the side walls and each other;

the main body being fabricated solely from a plastic, material wherein the reinforcement structure further comprises:

A plurality of secondary reinforcement webs integrally connected to and extending angularly between each of the primary reinforcement webs and a corresponding pair of the channel members, each of the secondary reinforcement webs further being integrally connected to the inner surface of the top wall and extending generally perpendicularly relative thereto.

2. The scaffold plank of claim 1 wherein each of the channel members has a solid cross-sectional configuration.

3. The scaffold plank of claim 1 wherein:

each of the channel members defines an elongate slot; and the scaffold plank further comprises a plurality of reinforcement bars disposed within respective ones of the slots.

4. The scaffold plank of claim 3 wherein each of the reinforcement bars is fabricated from steel.

5. The scaffold plank of claim 1 further comprising a cover member attached to the channel members, the primary reinforcement webs, and the secondary reinforcement webs of the reinforcement structure.

6. The scaffold plank of claim 1 wherein the outer surface of the top wall is textured.

7. The scaffold plank of claim 1 further comprising a pair of end walls integrally connected to and extending along respective ones of the lateral sides of the top wall.

* * * * *